US005080184A

United States Patent [19]

Yamakita et al.

[11] Patent Number: 5,080,184

[45] Date of Patent: Jan. 14, 1992

[54] METHOD OF AND APPARATUS FOR WEIGHING AND TAKING OUT POWDERED DYE

[75] Inventors: Yoshimichi Yamakita; Mitsugu Umino; Hisayoshi Mizuhara; Hiroshi Yoshida, all of Toyama, Japan

[73] Assignee: Yoshida Kogyo K.K., Tokyo, Japan

[21] Appl. No.: 653,976

[22] Filed: Feb. 11, 1991

Related U.S. Application Data

[63] Continuation of Ser. No. 481,058, Feb. 16, 1990, abandoned.

[30] Foreign Application Priority Data

Feb. 23, 1989 [JP] Japan ..... 1-44972

[51] Int. Cl.[5] ..... G01G 19/22

[52] U.S. Cl. ..... 177/1; 177/70

[58] Field of Search ..... 177/1.70

[56] References Cited

U.S. PATENT DOCUMENTS 4,390,822 6/1983 Wechsler ..... 318/114

4,934,009 6/1990 Yamauchi et al. ..... 8/527

FOREIGN PATENT DOCUMENTS 0299522 7/1988 European Pat. Off. .

3722453 1/1989 Fed. Rep. of Germany .

*Primary Examiner*—George H. Miller, Jr.

*Attorney, Agent, or Firm*—Hill, Van Santen, Steadman & Simpson

[57] ABSTRACT

A method which enables a dye to be weighted and taken out quickly at a high accuracy regardless of the required quantity of the dye by taking out the greater part of the required quantity of the dye in a powdery state and the remaining quantity of the dye in the state of a diluted solution, upon taking out the required quantity of the powdered dye, and an apparatus suitable for carrying out the above-mentioned method.

2 Claims, 4 Drawing Sheets

METHOD OF AND APPARATUS FOR WEIGHING AND TAKING OUT POWDERED DYE

This is a continuation of U.S. Pat. application Ser. No. 481,058, filed Feb. 16, 1990 now abandoned.

BACKGROUND OF THE INVENTION

1. Field of the Invention

This invention relates to a method of weighing and taking out a powdered dye used for dye adjusting purposes in case of dyeing textile products and synthetic resin products, etc. and an apparatus suitable for carrying out the method, and more particularly, to a method and an apparatus for weighing and taking out a powdered dye efficiently to thereby enable the error or deviation from a required quantity of a powdered dye to be minimized.

2. Description of the Prior Art

To conduct dyeing treatments satisfactorily, it is required basically to adjust a dye liquor containing a proper required quantity of a dye. In case the dye is powdery, it is not always easy to weigh and take out a required quantity of the powdered dye accurately.

As a conventional method of weighing and taking out a powdered dye stored in a container, there has so far been carried out to take out the dye in an approximately required quantity by means of a measuring means such as a measuring cup, or by flowing it out from the lower part of the container and compensating for the surplus or the deficiency of the dye by means of an weighing instrument such as an electronic weigher, or alternatively to dilute the powdered dye, taken out by the same procedure as mentioned above in a quantity slightly more than the required amount, with a liquid such as, for example, water so as to prepare a dye liquor having a known dye concentration, and then taking the dye liquor in a quantity which contains the proper required quantity of the powdered dye out of the prepared dye liquor.

Out of the above-mentioned two conventional methods of weighing and taking out powdered dye, the former method wherein a dye is taken out in powdery state has been conducted commonly in laboratories. However, since this method is troublesome in weighing and compensating the surplus or the deficiency and is therefore inefficient for industrial application, it has been carried out generally to control the quantity of a powdered dye flowing out from a container by means of a fixed quantity delivery means in an error range of ±0.5–0.25 gr.. In case of dyeing, if the quantity of a powdered dye contained in a dye liquor has an error or deviation of 1% or more from a required quantity, then there occurs a visually different result of dyeing. Therefore, the above-mentioned former method of taking out a powdered dye has been used in case of large lot dyeing using a dye liquor containing a required quantity of more than 50 gr. of the dye in which the dye can be weighed and taken out at a high accuracy, but in case of small lot dyeing using a dye liquor containing a required quantity of less than 50 gr. of the dye has required troublesome reweighing and compensation.

Whilst, the latter method wherein a powdered dye is weighed and taken out in the form of a diluted solution which contains a required quantity of the dye provides a highly accurate weighing depending on the degree of dilution. According to this method, however, the quantity of the diluted solution increases with an increase in the required quantity of the dye thus posing problems on installation and operations, and also in case a large quantity of the dye liquor is kept in custody, there is a possibility of aging of the dye liquor. Therefore, the latter method is used only for trial dyeing, sample dyeing and small-lot dyeing, etc. wherein a small quantity of a dye is taken out and used.

SUMMARY OF THE INVENTION

The present invention has been made in view of the above-mentioned circumstances in the prior art, and has for its object to provide a method of weighing and taking out a powdered dye, which is completely free from bad influence by an error which occurs at the time of weighing and taking out the powdered dye and which enables the dye to be weighed and taken out quickly and at a high accuracy regardless of the required quantity of the dye thereby improving the efficiency of dyeing operation and achieving a satisfactory result of dyeing, and also an apparatus suitable for carrying out the method.

To achieve the above-mentioned object, according to a first aspect of the present invention, there is provided a method of weighing and taking out a powdered dye, comprising, upon weighing and taking out a required quantity of the powdered dye used for dye adjusting purposes, a first step of taking out and weighing the powdered dye in a quantity slightly less than the required quantity; a second step of taking out and weighing the powdered dye in a quantity slightly more than the value of difference between the weighed value of the powdered dye obtained in the first step and the required quantity, and adding to the powdered dye a liquid, such as water or a solvent or a dispersion medium, at a particular ratio to the weighed value to prepare a diluted solution having a known dye concentration, and a third step of partially taking the diluted solution in a predetermined quantity which contains the powdered dye of the value of difference out of the diluted solution prepared in the second step and adding it to the powdered dye obtained in the first step.

To achieve the above-mentioned object, according to a second aspect of the present invention, there is provided a method of weighing and taking out a powdered dye, comprising, upon weighing and taking out a required quantity of the powdered dye used for dye adjusting purposes; a first operation of weighing and taking out the powdered dye by setting a quantity obtained by subtracting a known maximum powdered dye taking-out error based on powdered dye taking-out means from the required quantity as a target value; a second operation of taking out and weighing the powdered dye in a quantity more than the maximum powdered dye taking-out error, and adding to the powdered dye a liquid, such as water or a solvent or a dispersion medium at a particular ratio to the weighed value to prepare a diluted solution having a known dye concentration; and a third operation of taking partially the diluted solution in a predetermined quantity, which includes the value of difference between the weighed value of the powdered dye obtained in the first operation and the required quantity, out of the diluted solution prepared in the second operation, and adding the diluted solution to the powdered dye obtained in the first operation.

To achieve the above-mentioned object, according to a third aspect of the present invention, there is provided an apparatus for weighing and taking out a powdered dye, comprising: a powdered dye storage tank (1), a large quantity powdered dye discharge pipe (2) and a small quantity powdered dye discharge pipe, each being connected to the lower part of the storage tank and each having a fixed quantity delivery means associated therewith; a first dye container located below the large quantity powdered dye discharge pipe and placed on a first weighing device; a second dye container located below the small quantity powdered dye discharge pipe and placed on a second weighing device; a liquid supply pipe for supplying a liquid such as water or a solvent or a dispersion medium into the second dye container; and a pump piping system for transferring a predetermined quantity of a diluted solution having a particular dye concentration prepared in the second dye container into the first dye container, wherein the operations of the fixed quantity delivery means associated with the large quantity powdered dye discharge pipe and the small quantity powdered dye discharge pipe, respectively, the liquid supply pipe and a pump of the pump piping system are controlled by a computor in accordance with the weighed value or values obtained as a result of weighing by any one or both of the weighing devices.

To achieve the above-mentioned objects, in accordance with a fourth aspect of the present invention, there is provided an apparatus for weighing and taking out plural kinds of powdered dyes, comprising: a plurality of powdered dye storage tanks located in a row; large quantity powdered dye discharge pipes each having a fixed quantity delivery means associated therewith and being connected to the lower part of each storage tank so as to project on one side of the row of the storage tanks; small quantity powdered dye discharge pipes each having a fixed quantity delivery means associated therewith and projecting on the other side of the row of the tanks; a first weighing device mounted so as to be movable on a path located below the large quantity powdered dye discharge pipes of the storage tanks and extending in parallel with the row of the tanks; a first dye container resting on the first weighing device; a second weighing device mounted so as to be movable on a path located below the small quantity powdered dye discharge pipes of the storage tanks and extending in parallel with the row of the tanks; second dye containers each being located below the small quantity powdered dye discharge pipe of each storage tank and between the small quantity powdered dye discharge pipe and the path on which the second weighing device is moved, each of the second dye containers being located on and supported by the second weighing device so as to be selectively weighed by the latter every storage tank; liquid supply pipes each supplying a liquid such as water or a solvent or a dispersion medium into each of the second dye containers associated therewith; and pump piping systems provided separately for each of the second dye containers so as to transfer a diluted solution having a particular dye concentration prepared therein into the first dye container, wherein the movement of the first and second weighing devices to positions opposite to a particular one of the powdered storage tanks located in a row, and operations of the fixed quantity delivery means associated with the large quantity powdered dye discharge pipe and the small quantity powdered dye discharge pipe, respectively, of the particular storage tank, the two weighing devices, the liquid supply pipe and a pump of the pump piping system associated with the particular storage tank are controlled by a computor in accordance with a particular program and the values obtained as a result of weighing by the two weighing devices.

According to the method of the present invention as set forth in the first and second aspects, a powdered dye can be weighed and taken out easily and with a high accuracy by taking out and weighing most of a required quantity of the powdered dye directly in a powdery state, and taking out the remaining quantity of the powdered dye separately in the state of a diluted solution thereby eliminating the bad influence due to an error range in the discharge by the fixed quantity delivery means. Further, according to the first apparatus set forth in the third aspect of the present invention, the above-mentioned method for weighing and taking out a single powdered dye can be carried out simply. Still further, according to the second apparatus as set forth in the fourth aspect, the above-mentioned method can be effected repeatedly to weigh and takeout plural kinds of powdered dyes in turn and continuously in accordance with their respective required quantity. The use of the second apparatus is extremely advantageous in terms of costs of equipment and operation as compared with the case of using a plurality of the first apparatuses.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

The method and apparatus of the present invention will now be described below by way of embodiments thereof with reference to the accompanying drawings.

Figure 1:
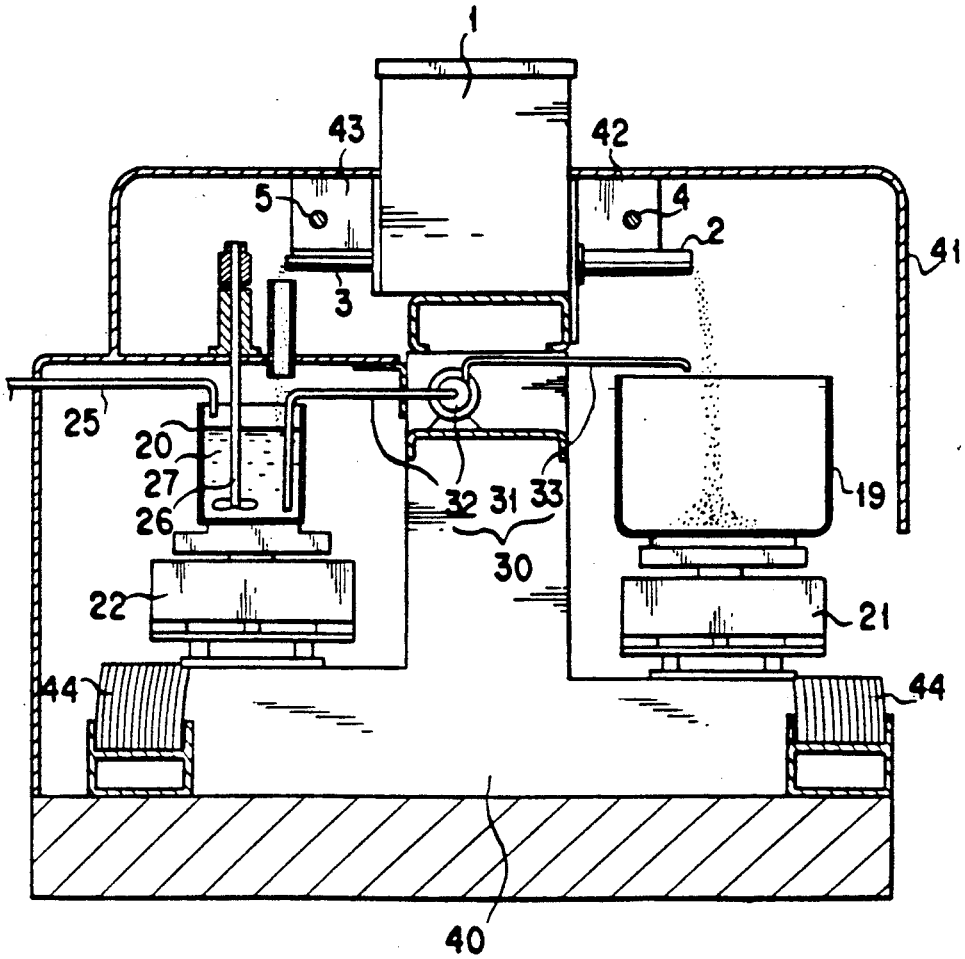
FIG. 1 is a fragmentary front view showing the section of the principal parts of a first apparatus according to the present invention.

FIG. 1 is a fragmentary front view showing the section of the principal parts of the first apparatus according to the present invention.

In the drawings, reference numeral 1 denotes a storage tank for storing a powdered dye; 2 a large quantity powdered dye discharge pipe projecting from the lower part of the storage tank 1 and provided with a fixed quantity delivery means; 3 a small quantity powdered dye discharge pipe provided with a fixed quantity delivery means; 21 a first weighing device which is an electronic weigher located below the large quantity powdered dye discharge pipe 2; 19 a first dye container placed on the first weighing device 21; 22 a second weighing device which is an electronic weigher located below the small quantity powdered dye discharge pipe 3; and 20 a second dye container placed on the second weighing device 22.

Further, reference numeral 25 denotes a liquid supply pipe for supplying a liquid such as water or a solvent or a dispersion medium for dye into the second dye container 20; 26 a stirrer; and 30 a pump piping system which includes a pump 31, a suction pipe 32 connected to the suction side of the pump 31 and which is inserted into the second dye container 20, and a discharge pipe 33 whose leading end opens above the first dye container 19.

Reference numeral 40 denotes a bed; 41 a cover; 42 and 43 branckets for supporting rotating drive shafts 4, 5 adapted to actuate the fixed quantity delivery means associated with the above-mentioned large quantity powdered dye discharge pipe 2 and small quantity powdered dye discharge pipe 3, respectively; and 44 electrical wirings for the first and second weighing devices 21 and 22.

Figure 2:
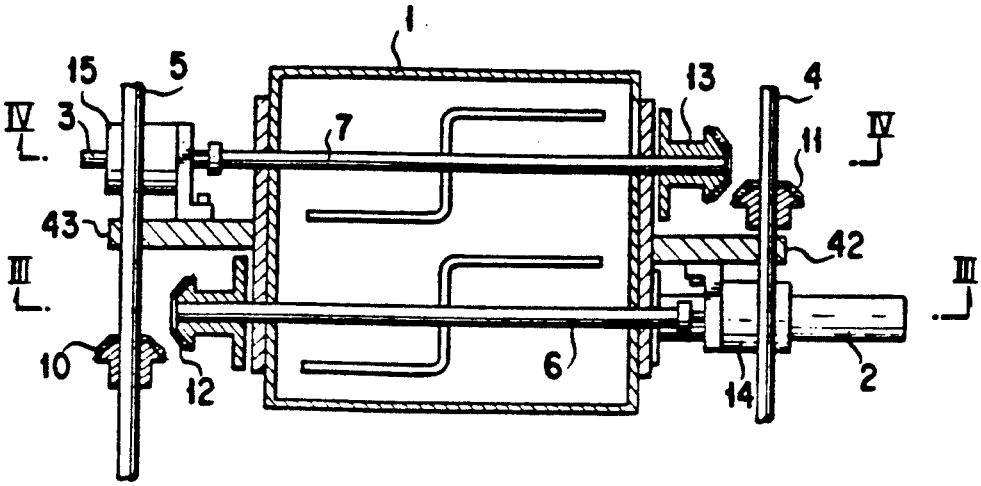
FIG. 2 is a horizontal sectional view of a powdered dye storage tank.
Figure 3:
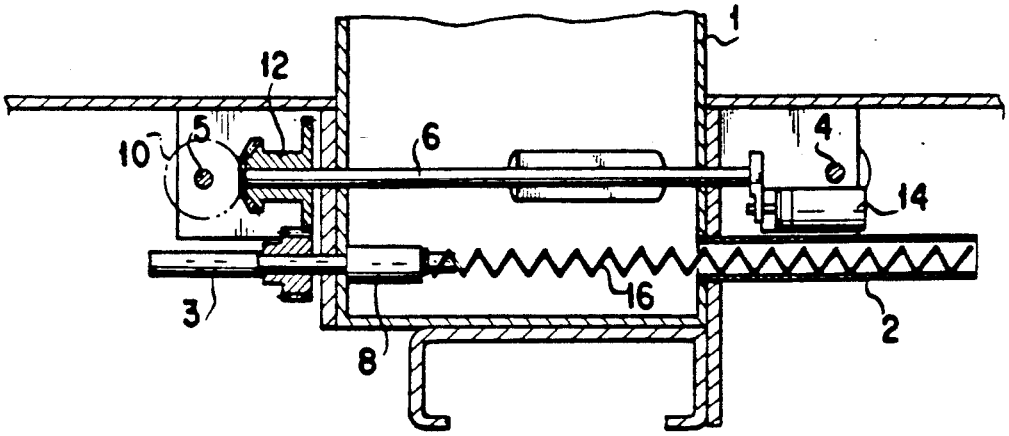
FIGS. 3 and 4 are sectional views of the tank taken along lines III—III and IV—IV, respectively, in FIG. 2.
Figure 4:
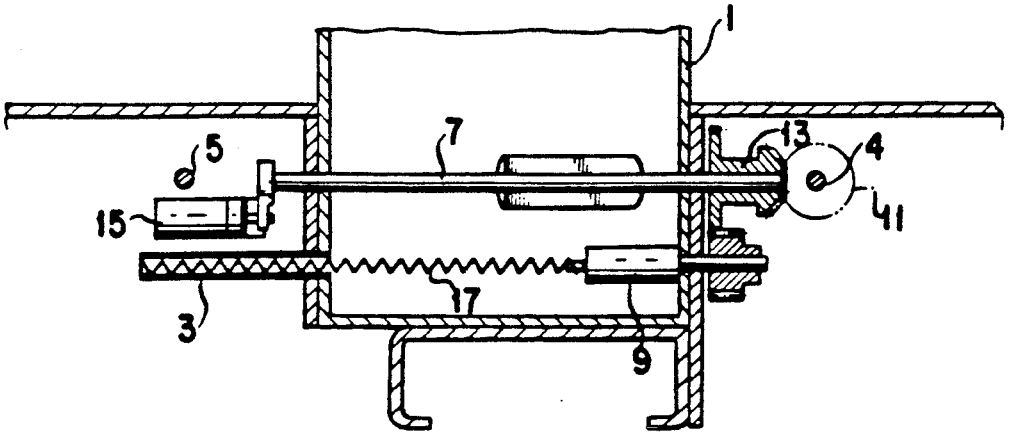

FIGS. 2, 3 and 4 show the large quantity powdered dye discharge pipe 2 and the small quantity powdered dye discharge pipe 3, respectively, connected to the lower part of the storage tank 1, and the fixed quantity delivery means associated with the discharge pipes 2 and 3, respectively. The large quantity powdered dye discharge pipe 2 is a pipe having a large bore which extends outwardly from the tank wall and in which a helical or screw member 16 extends through the interior of the tank 1 and along the entire length of the large quantity powdered dye discharge pipe 2. The rear end of the helical or screw member 16 is fixedly secured to and supported by a rotating support shaft 8 which extends through the tank wall. Provided above the spiral or screw member 16 and the shaft 8 is a rotating shaft 6 which has a stirring blade mounted thereon and which passes through the tank wall and is supported so as to be slidably moved in the axial direction thereof. One end of the rotating shaft 6 is connected through a sliding-contact coupling to the operating end of a first air cylinder 14, whilst the other end thereof has fixedly secured thereto a bevel gear 12 fitted with a spur gear which meshes with the spur gear mounted on the above-mentioned rotating support shaft 8. With the piston rod within the first air cylinder 14 being extended outwardly, the bevel gear 12 having a spur gear mounted thereon is allowed to mesh with a bevel gear 10 mounted on the rotating drive shaft 5 so as to rotate the rotating shaft 6 fitted with a stirring blade, and also turn, through the intermeshing of the spur gears, the rotating support shaft 8 and the helical or screw member 16 fixedly secured thereto, so that the powdered dye stored in the storage tank 1 is subjected to a stirring action made by the stirring blade mounted on the rotating shaft 6 and also a quick powder delivery action caused by the turning of the helical or screw member 16 having a relatively large pitch within the powdered dye discharge pipe 2 having a relatively large bore thus discharging a large quantity of the powdered dye. Subsequently, when the piston rod in the first air cylinder 14 is withdrawn to its initial position, the bevel gear 12 is disengaged from the bevel gear 10 of the rotating drive shaft 5 to thereby stop the rotation of the shafts 6 and 8 and the turning of the herical or screw member 16.

The small quantity powdered dye discharge pipe 3 is smaller in bore than the large quantity powdered discharge pipe 2, and has a helical or screw member 17 inserted therein to cause powdered dye delivery action. With the exception that the helical or screw member 17 is smaller in diameter and pitch than the helical or screw member 16 and is capable of deliverying powdered dye with a higher accuracy than the former, powdered dye delivery action and the stoppage thereof provided by connection and disconnection between a rotating shaft 7 having a stirring blade mounted thereon, and a rotating support shaft 9, and also that between a bevel gear 11 mounted on the rotating drive shaft 4 and a bevel gear 13 due to actuation of a second air cylinder 15 can be made entirely in the same manner as aforementioned.

One embodiment of the method of weighing and taking out a powdered dye using the above-mentioned first apparatus will be described below.

The maximum error (P) of the accuracy of taking out powdered dye from the large quantity powdered dye discharge pipe 2 of this apparatus is ±0.5 gr., the maximum error of the accuracy of taking out powdered dye from the small quantity powdered dye discharge pipe 3 is ±0.35 gr., the measuring accuracy of the two electronic weighers is ±0.005 gr., and the maximum error of the liquid supply accuracy of the pump piping system is ±0.25 cc. The required quantity (a) of the powdered dye is input to a computor, not shown. If the value of required quantity of the dye is 9.36 gr., then the computor will output the value to the first weighing device 21, and at the same time command the fixed quantity delivery means associated with the large quantity powdered dye discharge pipe 2 of the storage tank 1 to deliver the powdered dye by an amount of 8 gr. which is less by one than the figure at the units place of the value of required quantity. If the weighted value (b) of the powdered dye received in the first dye container 19 is 8.5 gr., then the value (c) of difference of 0.86 gr. between the required quantity (a) and the weighed value (b) which needs to be supplemented is stored by the computor. Whilst, to cover the error range of the accuracy, the computor will command the fixed quantity delivery means associated with the small quantity powdered dye discharge pipe 3 to deliver the powdered dye by an amount of 1.56 gr. which equals to the value (c) of difference plus 0.7 gr. Then, the powdered dye discharged into the second dye container 20 is weighed by the second weighing device 22, and the weighed value is assumed to be 1.5 gr.. Subsequently, the computer will command the liquid supply pipe 25 to supply 750 cc of water to prepare diluted solution of 0.2%, and at the same time command the stirrer 26 to start to stir the solution, and then command the pump 31 in the pump piping system to transfer the diluted solution of 430 cc (including 0.86 gr. of the dye) into the first dye container 19 to thereby supplement the dye liquor with the accuracy of error range of ±0.25 cc. As a result, a dye liquor containing the dye of 9.36 ±0.0005 gr., error or deviation of which from the required quantity is extremely small, is obtained in the first dye container 19.

Figure 5:
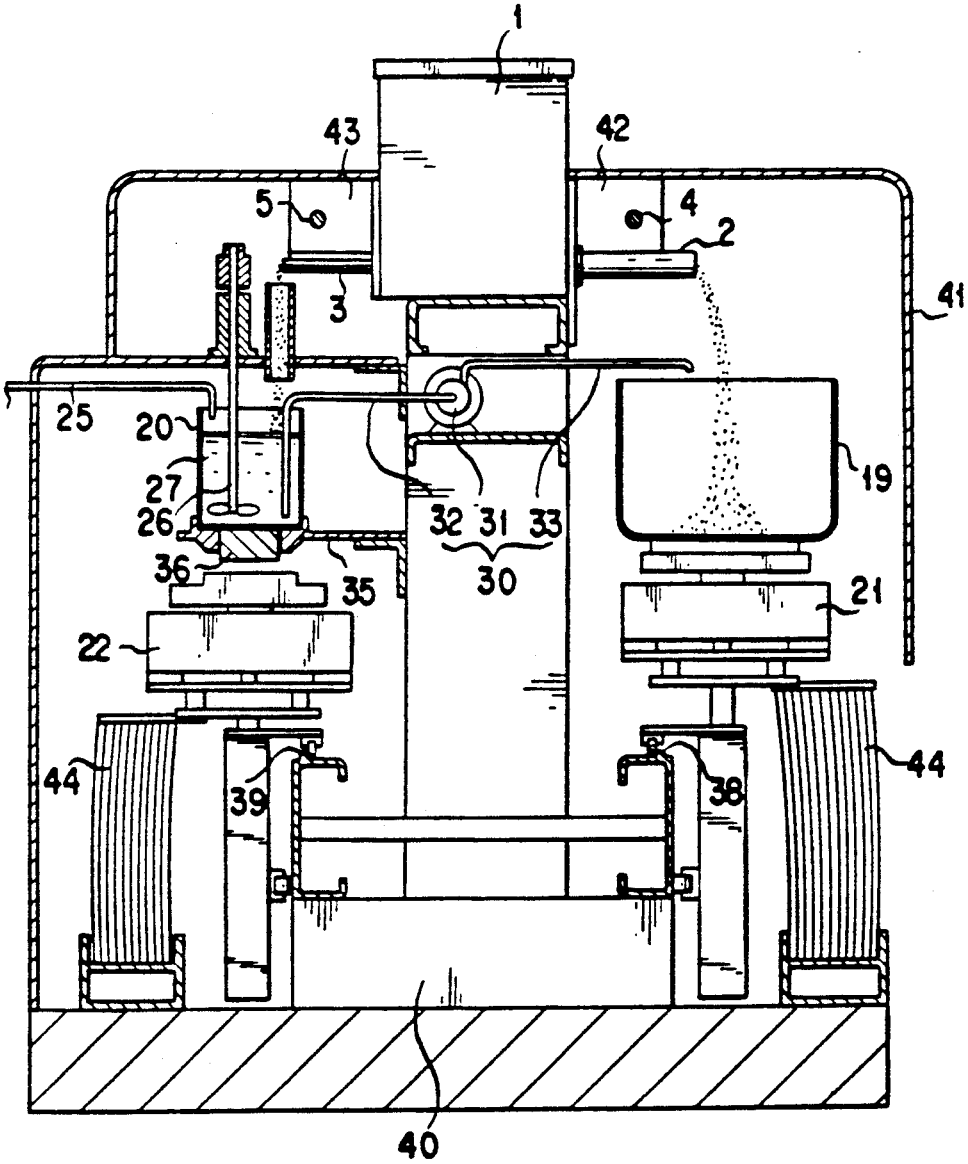
FIG. 5 is a fragmentary front view showing the section of the principal parts of a second apparatus according to the present invention.
Figure 6:
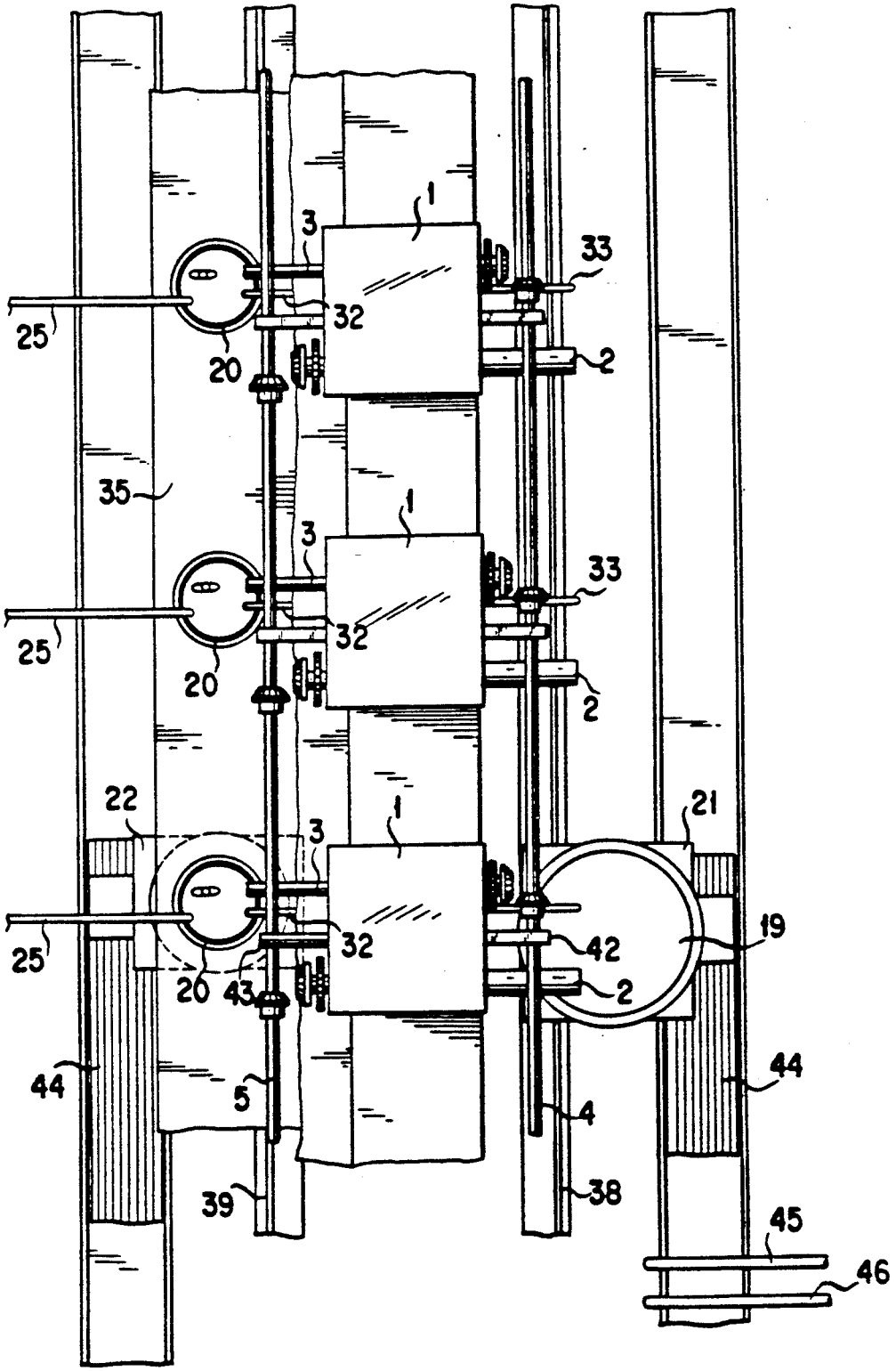
FIG. 6 is a plane view of the second apparatus of the present invention.

In the next place, an embodiment of the second apparatus of the present invention will be described below with reference to FIG. 5 which is a fragmentary front view showing the section of the principal parts thereof, and FIG. 6 showing the plan view thereof.

This apparatus comprises a plurality of unit devices having nearly the same arrangement as those of the above-mentioned first apparatus. This apparatus comprises a plurality of storage tanks 1, in which different kinds of powdered dyes are stored, and is arranged such that the aforementioned operations are made in turn and continuously every storage tank 1. The component parts of this apparatus having the same function as those of the afore-mentioned first apparatus are indicated with the same reference numerals. As already mentioned, this apparatus comprises a plurality of storage tanks 1, located in a row, and each of the tanks 1 has a large quantity powdered dye discharge pipe 2 projecting on one side of the row thereof and a small quantity powdered dye discharge pipe 3 projecting one the other side of the row thereof. Two guide rails 38 and 39 are mounted below the discharge pipes 2 and 3, respectively, and in parallel with the row of the storage tanks 1. Further, a first weighting device 21 which is an electronic weigher and a second weighting device 22 which is also an electronic weigher are arranged so that they may be moved on the guide rails 38 and 39, respectively. Both the weighting devices 21 and 22 are controlled such that they may be moved by transfer chains to positions opposite to a particular or any relevant storage tank 1 and stopped there.

The first weighting device 21 holds a first dye container 19 resting thereon, whilst the second weighing device 22 has a dish-shaped surface adapted to support and raise a second dye container 20 resting on a base 36 together the latter every dye storage tank 1. The base 36 is arranged to be moved up and down and loosely fitted in an opening formed in a rack 35. When the second weighing device is arranged to support and raise the container 20 together with the pedestal 36, it is ready for commencing its weighing operation.

A pump piping system 30 is provided independently for each of the dye storage tanks 1, and a liquid supply pipe 25 and a stirrer 26 are provided for each of the second dye containers 20.

By controlling the movement of the first and second weighing devices 21 and 22 to positions opposite to a particular one out of the powdered dye storage tanks 1 located in a row by a computor, and also by controlling the weighing and taking-out of the powdered dyes at respective tanks by the computor in the same manner as in the case of the aforementioned first apparatus, a required quantity of each of different kinds of powdered dyes stored in each of the storage tanks can be transferred or taken in the first dye container 19 with a minimum error or deviation.

It is a matter of course that in the case of the above operation the value of required quantity commanded by the computor to the first weighing device 21 is the total value of required quantities of different kinds of dyes.

Thus, the first dye container 21 in which the weighed and delivered dye is accommodated is transfered to a position where a diluted liquid supply pipe 45 and a dyeing aid supply pipe 46 are installed where the diluted liquid and the dyeing aid is added to the dye to prepare a desired dye liquor composition, which is then transported to a dyeing apparatus.

In the above-mentioned embodiment, if the conditions of the second apparatus controlled by the computor are changed, then a second method of the present invention can be carried out.

It is to be understood that the foregoing description is merely illustrative of preferred embodiments of the present invention, and that the scope of the invention is not to be limited, thereto, but is to be determined by the scope of the appended claims.

What is claimed is:

1. A method of weighing and taking out a powdered dye, comprising: upon weighing and taking out a required quantity (a) of the powdered dye used for dye adjusting purpose, a first step of taking out and weighing the powdered dye in a quantity slightly less than the required quantity (a); a second step of taking out and weighing the powdered dye in a quantity slightly more than the value (c) of difference between the weighed value (b) of the powdered dye obtained in said first step and the required quantity (a); and adding to the powdered dye of the second step a liquid, such as water or a solvent or a dispersion medium, at a particular ratio to the weighed value to prepare a diluted solution having a known dye concentration, and a third step of partially taking the diluted solution in a predetermined quantity which contains the powdered dye of the value (c) of difference out of the diluted solution prepared in the second step and adding it to the powdered dye obtained in said first step.

2. A method of weighing and taking out a powdered dye, comprising, upon weighing and taking out a required quantity (a) of the powdered dye for dye adjusting purposes, a first operation (i) of weighing and taking out the powdered dye by setting a quantity (Q) obtained by subtracting a known maximum powdered dye taking-out error (P) based on powdered dye taking-out means from the required quantity (a) as a target value providing a weighed value (b), a second operation (ii) of taking out and weighing the powdered dye in a quantity more than said maximum powdered dye taking-out error (P), and adding to the powdered dye of second operation (ii) a liquid, such as water or a solvent or a dispersion medium, at a particular ratio to the weighed value (d) to prepare a diluted solution having a known dye concentration; and a third operation (iii) of taking partially the diluted solution in a predetermined quantity, which includes the value (c) of difference between the weighed value (b) of the powdered dye obtained in the first operation (i) and the required quantity (a), out of the diluted solution prepared in the second operation (ii), and adding a portion of the diluted solution to the powdered dye obtained in the first operation (i).

* * * * *